US005806361A

United States Patent [19]

Kitamura et al.

[11] Patent Number: 5,806,361

[45] Date of Patent: Sep. 15, 1998

[54] ROLLING-MILL ROLL OF BARREL-WIDTH ADJUSTABLE TYPE

[75] Inventors: Takashi Kitamura; Tetsuhiko Kanda, both of Kitakyusyu, Japan

[73] Assignee: Nippon Steel Corporation, Tokyo, Japan

[21] Appl. No.: 669,511

[22] PCT Filed: Nov. 11, 1994

[86] PCT No.: PCT/JP94/01920

§ 371 Date: Jul. 10, 1996

§ 102(e) Date: Jul. 10, 1996

[87] PCT Pub. No.: WO96/14945

PCT Pub. Date: May 23, 1996

[51] Int. Cl.[6] ..... B21B 13/10; B21B 31/07; B21B 31/18

[52] U.S. Cl. ..... 72/247; 29/125; 72/224; 72/238

[58] Field of Search ..... 72/225, 247, 249, 72/224, 238, 199; 29/124, 125

[56] References Cited

FOREIGN PATENT DOCUMENTS

| | | | |
|---|---|---|---|
| 17310 | 1/1986 | Japan | 72/247 |
| 62-176604 | 8/1987 | Japan . | |
| 62-156007 | 11/1987 | Japan . | |
| 60-72603 | 7/1989 | Japan . | |
| 3-210907 | 9/1991 | Japan . | |
| 4-4909 | 1/1992 | Japan . | |

*Primary Examiner*—Lowell A. Larson
*Assistant Examiner*—Rodney Butlar
*Attorney, Agent, or Firm*—Kenyon & Kenyon

[57] ABSTRACT

The present invention provides a rolling-mill roll of a barrel-width adjustable type improved in strength by preventing stress concentration in a torque transmission structure for transmitting the torque from drive side roll to another roll. The connecting rod coaxially projected from the drive side arbor is inserted into the sleeve, and the rolls are mounted onto the circumferences of the connecting rod and the sleeve. The connecting rod and the sleeve are supported in a housing via bearings and are coupled with each other by a screw shaft mechanism so that the sleeve is axially movable to vary the barrel width. The complementary engagement between the spline or key for transmitting the torque of the arbor to the sleeve is made at a position offset outward from the axial center of the sleeve bearing so that the complementary engagement is not affected by the bending of the roll due to the rolling reaction and thus a stress concentration is prevented.

6 Claims, 2 Drawing Sheets

ROLLING-MILL ROLL OF BARREL-WIDTH ADJUSTABLE TYPE

TECHNICAL FIELD

The present invention relates to a horizontal roll for rolling shape steels of various sizes, particularly to a rolling-mill roll of which the barrel width is freely adjustable in accordance with a change in the width of the shape steel to be rolled.

BACKGROUND ART

In rolling shape steels having various sizes, a barrel width of a horizontal roll in a universal mill, edging mill or the like must be changed in accordance with the sizes of the shape steel to be rolled. In the prior art, many sets of rolls having different barrel widths corresponding to the sizes of the shape steels to be rolled are adjusted and prepared in advance, and one set of the rolls having a suitable width is selected and changed every time the size of the shape steel is changed. The operation of changing the roll is very time-consuming and increases the production cost.

Recently, to improve the changing operation of the roll, a rolling mill structure wherein the barrel width of a horizontal roll for rolling a shape steel is variable has been put into practice. For example, in rolling of an H-shape steel, a universal mill or an edger mill capable of corresponding to a change of product specification is adopted, or a rolling-mill roll of which a barrel width is adjustable in accordance with the change of the specification is mounted.

For example, Japanese Unexamined Patent Publication No. 62-156007 discloses a rolling-mill roll of a barrel-width adjustable type having a roll section fixed at a position in the axiswise direction and coupled to a drive side, and another roll section movable in the axiswise direction by means of a barrel width adjustable screw. A barrel width corresponding to the width of a rolled shape steel can be set by changing the relative axiswise position of both the roll sections by means of the barrel width adjustment screw.

Such a rolling-mill roll of a barrel-width adjustable type requires a mechanism for transmitting torque from the drive side roll section to the roll for operating the width adjustment. According to one example of such transmission mechanism, a rod portion coaxially projected from the drive side roll section is inserted into the other roll section and fixedly coupled thereto by a spline or key.

DISCLOSURE OF THE INVENTION

According to the above-mentioned roll of a barrel-width adjustable type, the spline or key for coupling the roll sections is located at a position within a rolling width which coincides with the flange width of the H shape steel, and this position is at the side further from bearings of the movable roll section and nearer the rolling region.

Generally speaking, a large bending moment is generated in the roll during the rolling operation due to the rolling reaction, which moment is largest at a center of the rolling width and becomes smaller closer to the axiswise end portion of the roll. Accordingly, in the structure wherein the spline or key is built-in in the rolling region, a stress concentration is liable to occur due to not only the irregular profile thereof but also to the bending load caused by the rolling reaction.

Since there is a problem of stress concentration in the portion of the key or spline in the conventional roll, as described above, it is necessary, for example, to limit the rolling load to below a certain value or to strengthen rolls and other parts with high quality and expensive materials. In this regard, while it is also possible to increasing a roll size to improve the roll strength, this results in the enlargement of a total size of the installation, which is then far from the optimum design.

The present invention provides a rolling-mill roll of a barrel-width adjustable type being more compact in size and free from stress concentration.

Specifically, the barrel-width adjustable type rolling-mill roll is adapted to have an improved mechanical strength by preventing stress concentration from occurring in a coupling structure between a drive side roll and the other side roll. The gist thereof is as follows:

(1) A rolling-mill roll of a barrel-width adjustable type comprising an arbor provided on a roll drive side, a connecting rod coaxially projected from the arbor, and a sleeve into which the connecting rod is inserted to be movable in the axiswise direction, all of which are supported in a bearing box via bearings, wherein two roll sections are mounted onto the outer circumferences of the arbor and the sleeve, respectively, to form two divided roll sections so that a distance between both the roll sections is adjustable by varying the relative axiswise positions of the sleeve and the arbor, characterized in that a torque transmission structure for transmitting the torque from the connecting rod to the sleeve is based on the complementary engagement between the outer circumference of the connecting rod and the inner circumference of the sleeve, and the axiswise position of the engagement is located closer to an end portion of the roll than to the center of the bearing for supporting the outer circumference of the sleeve so that a stress concentration is prevented from occurring during the rolling operation.

(2) A rolling-mill roll of a barrel-width adjustable type according to (1), wherein a barrel-width adjustment screw shaft is provided at an end portion of the connecting rod and a clutch mechanism is provided, at one end of the screw shaft, which comprises a clutch shift cylinder, a slide box which is not spatially rotatable and has a gear part in the interior thereof, and a sleeve engagement gear synchronously rotatable with the sleeve.

(3) A rolling-mill roll of a barrel-width adjustable type forming two divided roll sections comprising two divided sleeve sections in the widthwise direction and inserted into an arbor as a common roll shaft to cause the sleeve sections to be movable thereon in the axiswise direction, all of which are mounted in a bearing box via bearings, wherein two roll sections are mounted onto the outer circumferences of the sleeve sections, respectively, so that a distance between the roll sections is adjustable by varying the relative axiswise positions of the sleeve sections and the arbor, characterized in that a torque transmission structure for transmitting the torque from the arbor to the sleeve is based on the complementary engagement between the outer circumference of the arbor and the inner circumference of the sleeve, and the axiswise position of the engagement is located closer to an end portion of the roll than to a center of the bearing for supporting the outer circumference of the sleeve so that a stress concentration is prevented from occurring during the rolling operation.

(4) A rolling-mill roll of a barrel-width adjustable type according to (3), wherein a barrel-width adjustment screw shaft is provided at an end portion of the arbor and a clutch mechanism is provided, at one end of the screw shaft, which comprises a clutch shift cylinder, a slide box which is not spatially rotatable and has a gear part in the interior thereof, and a sleeve engagement gear synchronously rotatable with the sleeve.

(5) A rolling-mill roll of a barrel-width adjustable type according to (1) or (3), wherein the torque transmission means is based on a spline or key engagement.

BEST MODE FOR CARRYING OUT THE INVENTION

Figure 1:
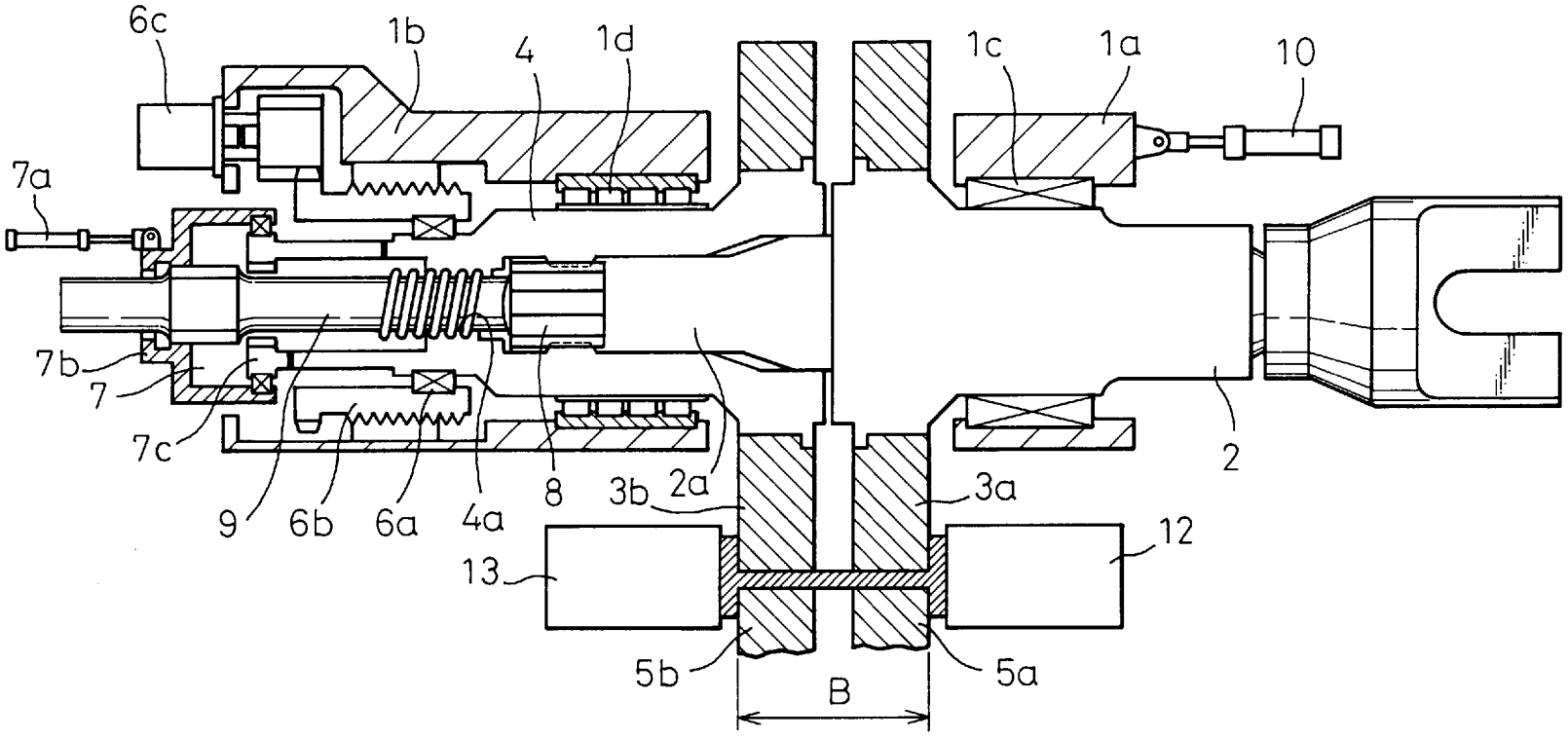
FIG. 1 is a diagrammatic side sectional view of a barrel width adjustable type rolling-mill roll according to the present invention.

The present invention provides a horizontal roll used for rolling shape steels, which is capable of varying a rolling width to enable the rolling of shape steels having various sizes, without the necessity of replacement of the roll, and is also improved in the structural strength because the stress concentration inherent to the conventional divided roll is prevented in a coupling zone between the two roll sections. That is, according to the present invention, the strength of the arbor against rolling torque, bending or torsion is improved compared with the prior art, because no notch effect occurs in the coupling zone, and thus a divided type roll structure of a compact size is attained.

According to a first aspect of the present invention, to prevent stress from concentrating in a torque transmission structure for transmitting the torque from a drive side roll section to another roll section, a connecting rod coaxially projected from an arbor on the drive side is inserted into a sleeve, and the roll sections mounted onto the arbor and the sleeve, respectively, are supported in a housing via bearings, wherein the connecting rod is coupled to the sleeve via a screw shaft so that the sleeve is movable in the axial direction to provide a rolling-mill roll capable of varying the barrel width. Further, a torque transmission structure of the rolling-mill roll based on the complementary engagement between the arbor and the sleeve by means of a spline, a key or others is located at a position offset toward an outer end from the axial center of the sleeve bearing so that the engagement is not affected by a stress concentration and bending due to the rolling reaction.

According to a third aspect of the present invention, an arbor common to two sleeve sections is inserted thereinto, and roll sections are mounted to the respective sleeve sections supported in a housing by bearings, wherein the arbor and the sleeve section are coupled with each other via a screw shaft so that the sleeve section is movable in the axial direction to result in the variation of the barrel width. The torque transmission structure for the rolling-mill roll is the same as that of the first aspect.

According to the above structures, the rolling reaction during the rolling operation is transmitted from the roll to the arbor and sleeve, and the maximum bending stress is applied to the sleeve area on which the roll is mounted and the arbor side connecting rod. Since no irregular profile for the purpose of the complementary engagement exists in this area of the sleeve and the connecting rod, a stress concentration therein is prevented. In addition, since the position of the complementary engagement is offset from a center of the bearing toward the roll outer end, a heavy load caused by the bending is all borne by the bearing so that the load applied on the engagement part is mitigated to a great extent even to zero, while only a small load necessary for the torque transmission is applied thereto.

The present invention will be described below in more detail with reference to the preferred embodiments illustrated in the drawings.

FIG. 1 is a sectional view of an embodiment of a rolling-mill roll of a barrel-width adjustable type as seen along a path of a shape steel to be rolled. Reference numeral 11 denotes an H shape steel to be clutch shift cylinder 7*a* and an internal gear part, and a sleeve engagement gear 7*c* rotatable in synchronism with the sleeve 4.

The clutch mechanism 7 is capable of selectively rotating the screw shaft 9 in synchronism with the sleeve 4 and the arbor 2 rotating therewith, or stopping the spatial rotation thereof.

That is, if a rod of the clutch shift cylinder 7*a* projects outward, the gear part of the slide box 7*b* is meshed with the gear part of the screw shaft 9 as shown in FIG. 1 to maintain the screw shaft 9 not to be spatially rotatable. If the arbor 2 and the sleeve 4 are made to rotate by a mill motor (not shown) in this state, the screw shaft 9 moves rightward or leftward relative to the arbor 2 via the screw engagement between the female thread 4*a* and the screw shaft 9, whereby the axial relative position of the arbor 2 to the sleeve 4 can be changed to adjust a distance between the roll sections 3*a*, 3*b*.

Thereafter, a path line is corrected by axially moving the arbor together with the sleeve by the path line centering motor 6*c*.

Figure 2:
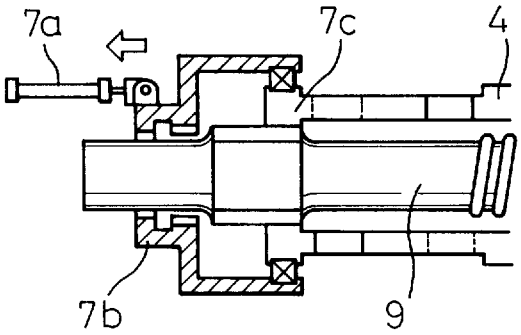
FIG. 2 shows an example of a maim part according to the present invention when a screw shaft is engaged with a slide engagement gear.

On the other hand, if the rod of the clutch shift cylinder 7*a* is retreated, the sleeve engagement gear 7*c* is meshed with the screw shaft 9 as shown in FIG. 2. Accordingly, the screw shaft 9 is rotated in synchronism with the sleeve 4 while keeping the same engagement state between the female screw 4*a* and the screw shaft 9, whereby the axial relative position of the arbor 2 to the sleeve 4 is unchanged to maintain a constant distance between both the roll sections 3*a*, 3*b*.

For example, the correction is carried out in the following manner when the width of the upper horizontal roll has been widened by W. After the rolling operation at the barrel width of B has been completed, the barrel width is adjusted to B+W. Then, the roll section 3*a* is immobile because the axial movement thereof is inhibited rolled by an upper horizontal roll consisting of horizontal roll sections 3*a*, 3*b*, a lower horizontal roll consisting of horizontal roll sections 5*a*, 5*b*, and a pair of vertical rolls 12, 13. While the following explanation will be made exclusively on the upper horizontal roll 3, this is also true to the lower horizontal roll 5.

In this drawing, an arbor 2 coupled to a drive motor and a reduction gear mechanism (not shown) is supported by a bearing 1*c* in a drive side bearing box 1*a*.

The arbor 2 has a connecting rod 2*a* coaxially projected therefrom and the roll section 3*a* integrally carried on the outer circumference thereof at a position closer to the bearing 1*c*.

The rod 2*a* is inserted into a sleeve 4 rotatably supported by a radial bearing Id accommodated in a driven side bearing box 1*b*. That is, the sleeve 4 is movable in the axial direction of the roll but inhibited from the rotation relative to the arbor by a torque transmission means (spline 8 in this embodiment). A roll section 3*b* mated with the arbor side roll section 3*a* is mounted on the outer circumference of the sleeve 4 at a position closer to an inner end thereof. The sleeve 4 is coupled to the bearing box 1*b* via a bearing 6*a* and a screw ring 6*b* so that the arbor and the sleeve are integrally movable in the axial direction either rightward or leftward by the action of a path line centering motor 6*c* for shifting the screw ring 6*b*. On the other hand, the bearing box la is supported in the axial direction of the roll by a pressing device 10 attached to a housing (not shown).

A screw shaft 9 for adjusting a barrel width is provided while abutting on the outer end of the connecting rod 2*a,* to be screw-engaged with a female thread 4*a* of the sleeve 4. At a leftside end of the screw shaft 9 is provided a clutch mechanism 7 including a slide box 7*b* which is not spatially rotatable and has a by the housing via the arbor 2 and the bearing box 1*a,* but the roll section 3*b* solely moves leftward in the drawing by W. This means that a roll center is offset leftward by half a W from the path line center defined as an arrangement center of the rolling line. Therefore, it is necessary to shift the horizontal roll as a whole, together with the arbor and the sleeve, in the axial direction by the path line centering motor 6*c* so that the roll center coincides with the path line center.

Figure 3:
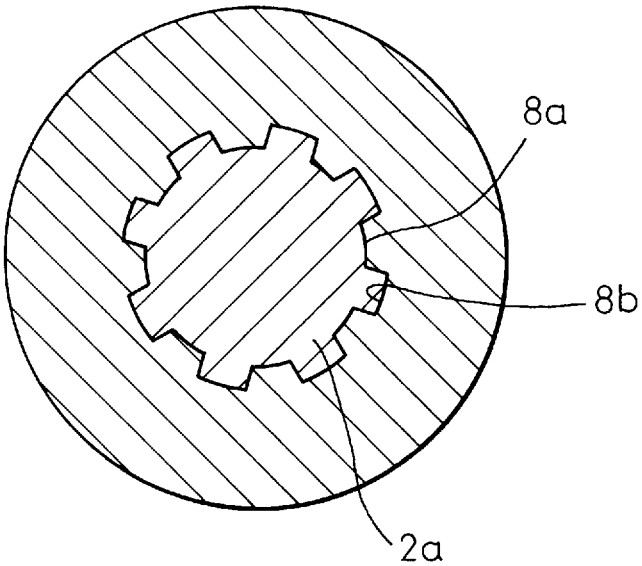
FIG. 3 is a cross-sectional view of one example of a spline structure between a connecting rod and a sleeve.

The spline 8 provided at a base end of the connecting rod 2*a* for transmitting the torque from the arbor 2 to the sleeve 4 may be of any kind usually used as a machine element; for example, ribs 8*a* and grooves 8*b* provided on the outer circumference of the connecting rod 2*a* and the inner circumference of the sleeve 4, respectively, to be fitted with each other as shown in FIG. 3 in an enlarged scale. The torque transmission structure formed by the spline 8 is provided at a position offset outward from the axial center of the bearing Id as shown in FIG. 1.

In the above structure, the rolling reaction during the rolling operation is applied from the roll sections 3*a,* 3*b* to the arbor 2, sleeve 4 and connecting rod 2*a*. There is no irregular profile, such as spline or others, in the area between the roll sections 3*a,* 3*b* and the center line of the bearing 1*d* as in the prior art, but the surface contour of these members is smooth and flat. Accordingly, a stress concentration hardly occurs in this area due to the rolling reaction, whereby the roll structure is sufficiently durable against the rolling reaction force, without increasing a diameter of such members or using a high quality material for the manufacture thereof.

Since the spline 8 on which the stress is liable to concentrate is located at a position offset outward from the axial center of the bearing 1*d,* most of the load caused by the bending due to the rolling reaction is borne by the bearing 1*d* so that the spline 8 is not affected thereby. Accordingly, the stress caused by the bending is prevented from concentration onto the spline 8, whereby the strength problem is eliminated.

In this regard, even when a key and a key-groove for transmitting the rotation of the arbor 2 is used instead of providing the spline 8 between the connecting rod 2*a* and the sleeve 4, the strength problem can be solved by locating the key and key groove at a position corresponding to that of the above spline 8.

According to a third aspect of the present invention, an arbor common to two roll sections is inserted into the two sleeve sections on which the roll sections are mounted, respectively, so that a symmetric arrangement is obtained. In this case, the torque transmission means is located at a position offset outward from the axial center of the bearing, similar to the first aspect, so that the same effect is obtainable as the first aspect.

Table 1 shows the comparison between the first aspect of the present invention applied to an actual roll mill and the prior art. It is apparent from this Table that the rolling-mill roll according to the present invention is durable against a force caused by the rolling reaction approximately 1.5 times to 2.3 times that durable by the conventional one if both the rolling-mill rolls have the same roll diameter and are made of the same material. Also, since the adjustment range of barrel width is approximately 1.7 times that of the conventional one, the roll design is significantly enhanced.

TABLE 1

| | | Present Invention | | Prior Art | |
|---|---|---|---|---|---|
| | Profile | R:100 | R:10 | R:100 | R:10 |
| Arbor strength | Bending Stress | 63.1 | 43.0 | 100 | 100 |
| | Result. Stress | 63.0 | 42.9 | 100 | 100 |

wherein a profile of prior art torque transmission means: 545 mm×505 mmϕ the adjustment range of prior art reduction roll: 75 mm a profile of inventive torque transmission means: 545 mmϕ the adjustment range of inventive reduction roll: 130 mm

INDUSTRIAL APPLICABILITY

According to the present invention, since a drive side arbor is coupled to a sleeve for the torque transmission by the complementary engagement between the profiled members such as spline or key located at a position apart from a point at which the bending due to the rolling reaction mainly occurs, it is possible to simplify the configuration of arbor and sleeve portions in which bending occurs, so that the stress concentration is prevented. Therefore, it is possible to obtain a proper strength of the rolling-mill roll without increasing the outer diameter of the arbor or sleeve, and also to provide a larger rolling load.

If the position of the spline or key is offset outward from the axial center of the bearing for supporting the sleeve on the housing, a force caused by the bending is borne by the bearing and the stress concentration due to the provision of the spline or key is mitigated.

We claim:

1. A rolling-mill roll of a barrel-width adjustable type comprising an arbor provided on a roll drive side, a connecting rod coaxially projected from the arbor, and a sleeve into which the connecting rod is inserted to be movable in the axiswise direction, all of which are supported in a bearing box via bearings, wherein two roll sections are mounted onto the outer circumferences of the arbor and the sleeve, respectively, to form two divided roll sections so that a distance between both the roll sections is adjustable by varying the relative axiswise positions of the sleeve and the arbor, characterized in that a torque transmission structure for transmitting the torque from the connecting rod to the sleeve is based on the complementary engagement between the outer circumference of the connecting rod and the inner circumference of the sleeve, and the axiswise position of engagement is located closer to an end portion of the roll than to a center of the bearing for supporting the outer circumference of the sleeve, so that a stress concentration is prevented from occuring during the rolling operation.

2. A rolling-mill roll of a barrel-width adjustable type according to claim 1, wherein a barrel width adjustment screw shaft is provided at an outer end of the connecting rod, and a clutch mechanism is provided at one end of the screw shaft, which comprises a clutch shift cylinder, a slide box which is not spatially rotatable and has a gear part in the interior thereof, and a sleeve engagement gear synchronously rotatable with the sleeve.

3. A rolling-mill roll of a barrel-width adjustable type according to claim 1, wherein the torque transmission means is based on a spline or key engagement.

4. A rolling-mill roll of a barrel-width adjustable type forming two divided roll sections comprising two divided sleeve sections in the widthwise direction and inserted into an arbor as a common roll shaft to cause the sleeve sections to be movable thereon in the axiswise direction, all of which are mounted in a bearing box via bearings, wherein two roll sections are mounted onto the outer circumferences of the sleeve sections, respectively, so that a distance between the roll sections is adjustable by varying the relative axiswise positions of the sleeve sections and the arbor, characterized in that a torque transmission structure for transmitting the torque from the arbor to the sleeve is based on the complementary engagement between the outer circumference of the arbor and the inner circumference of the sleeve, and the axiswise position of the engagement is located closer to an end portion of the roll than to a center of the bearing for supporting the outer circumference of the sleeve so that a stress concentration is prevented from occurring during the rolling operation.

5. A rolling-mill roll of a barrel-width adjustable type according to claim 4, wherein a barrel width adjustment screw shaft is provided at an end portion of the arbor and a clutch mechanism is provided at one end of the screw shaft, which comprises a clutch shift cylinder, a slide box which is not spatially rotatable and has a gear part in the interior thereof, and a sleeve engagement gear synchronously rotatable with the sleeve.

6. A rolling-mill roll of a barrel-width adjustable type according to claim 3, wherein the torque transmission means is based on a spline or key engagement.

* * * * *